US010792559B1

(12) United States Patent
Shoemaker, Jr.

(10) Patent No.: US 10,792,559 B1
(45) Date of Patent: Oct. 6, 2020

(54) ARCADE GAME WITH ALUMINUM CAN TARGETS

(71) Applicant: Stephen P. Shoemaker, Jr., Redondo Beach, CA (US)

(72) Inventor: Stephen P. Shoemaker, Jr., Redondo Beach, CA (US)

( * ) Notice: Subject to any disclaimer, the term of this patent is extended or adjusted under 35 U.S.C. 154(b) by 196 days.

(21) Appl. No.: 16/352,532

(22) Filed: Mar. 13, 2019

(51) Int. Cl.
*A63F 9/30* (2006.01)
*G07F 17/32* (2006.01)
*A63F 9/00* (2006.01)

(52) U.S. Cl.
CPC ..... *A63F 9/30* (2013.01); *A63F 9/0079* (2013.01); *G07F 17/3297* (2013.01); *A63F 2009/0081* (2013.01); *G07F 17/3216* (2013.01)

(58) Field of Classification Search
CPC ..... A63F 9/30; G07F 11/165
USPC ..... 273/447, 448, 440
See application file for complete search history.

(56) References Cited

U.S. PATENT DOCUMENTS 5,240,139 A * 8/1993 Chirnomas ..... A23G 9/28 221/123
5,513,772 A * 5/1996 Glaser ..... G07F 17/32 221/199
6,547,096 B1 * 4/2003 Chirnomas ..... G07F 5/18 221/123
6,598,881 B1 * 7/2003 Shoemaker, Jr. ..... A63F 9/30 273/447
8,070,167 B1 * 12/2011 Shoemaker, Jr. ..... A63F 9/30 273/447
8,079,494 B2 * 12/2011 Ubidia ..... B25J 9/041 221/123
9,822,893 B2 11/2017 Kunau
2016/0375356 A1 * 12/2016 Shoemaker, Jr. ..... A63F 9/30 273/447
2016/0375358 A1 * 12/2016 Shoemaker, Jr. ..... A63F 9/30 273/447
2016/0379450 A1 * 12/2016 Shoemaker, Jr. ... G07F 17/3297 273/447

* cited by examiner

*Primary Examiner* — Jeffrey S Vanderveen
(74) *Attorney, Agent, or Firm* — Fulwider Patton LLP

(57) ABSTRACT

The present invention is an arcade game with a crane mechanism that uses a suction device to capture and extract beverages in aluminum cans. The arcade game may use a rotating playing field where the targets sit on a turn-table type rotating disk, or the targets may be arranged on a stationary playing field. The pick-up device can use a joystick or other type of player controls to maneuver the pick-up device over the intended target, and then lowered onto the bottom surface of the inverted can in an attempt to extract the target from the playing field. The pick-up device preferably uses a suction cup that, if positioned directly over the bottom surface of the inverted can, will make a seal with the can and allow the can to be lifted from the playing field. If the suction cup is not placed directly over the can such that a seal is not established, the pick-up device will not be able to apply a fully negative pressure between the can and the pick-up device, and the attempt will fail. In the event of a successful attempt, the can is transferred to a retrieval bin adjacent the playing field where the player can obtain the prize.

4 Claims, 8 Drawing Sheets

ARCADE GAME WITH ALUMINUM CAN TARGETS

BACKGROUND

Arcade games are well known in the art, and particularly crane-type games where players maneuver a crane over targets in an attempt to extract the target from a playing field. The targets for claw-type arcade games have traditionally been plush toys that are easy to capture with the crane. However, the allure of plush toys, while popular with some, is not always an attraction for all players, particularly teens and young adults. Unfortunately, prizes that would be attractive to these players are not readily compatible with claw mechanisms. Thus, a large population of would-be players is lost due to the discrepancy between the types of prizes players want and a game that can work with such prizes that cannot be picked up with a claw type grasp. Aluminum cans are one such target.

SUMMARY OF THE INVENTION

The present invention is an arcade game with a crane mechanism that uses a suction device to capture and extract aluminum cans of beverages or other canned items. Many of the most popular beverages with teens and young adults comprise sodas and energy drinks that are sold in aluminum cans. In the United States, approximately five hundred billion aluminum cans are produced each year for beverages. The present invention provides a game that uses these aluminum cans as targets for a crane game, offering players a choice of different beverages to try and capture.

The arcade game may use a rotating playing field where the targets sit on a turn-table type rotating disk, or the targets may be arranged on a stationary playing field. In the former case, the pick-up device may move linearly across the turn-table as the targets pass below the crane, and in the latter case the pick-up device preferably moves in both a left to right and back to front directions to cover the entire playing field and therefore each of the targets. The pick-up device can use a joystick, buttons, or other type of player controls to maneuver the pick-up device over the intended target, and then lowered onto an inverted can in an attempt to extract the target from the playing field. The cans are inverted, i.e. placed upside down, because the lower surface of the can is round, smooth, flat and make a perfect target for the suction cup. The pick-up device preferably uses a suction cup that, if positioned directly over the upper surface of the can, will make a seal with the can and allow the can to be lifted from the playing field. If the suction cup is not placed directly over the can such that a seal is not established, the pick-up device will not be able to apply a fully negative pressure between the can and the pick-up device, and the attempt will fail. In the event of a successful attempt, the can is lifted to a retrieval bin adjacent the playing field where the player can obtain the prize. When the play is finished, the pick-up device returns to a parked position ready for the next play.

The present game is the first arcade game to use aluminum cans as a target/prize, and the opportunity to attract an even larger market to the crane-type arcade game is a major advance over the existing games.

DETAILED DESCRIPTION OF THE PREFERRED EMBODIMENTS

Figure 1:
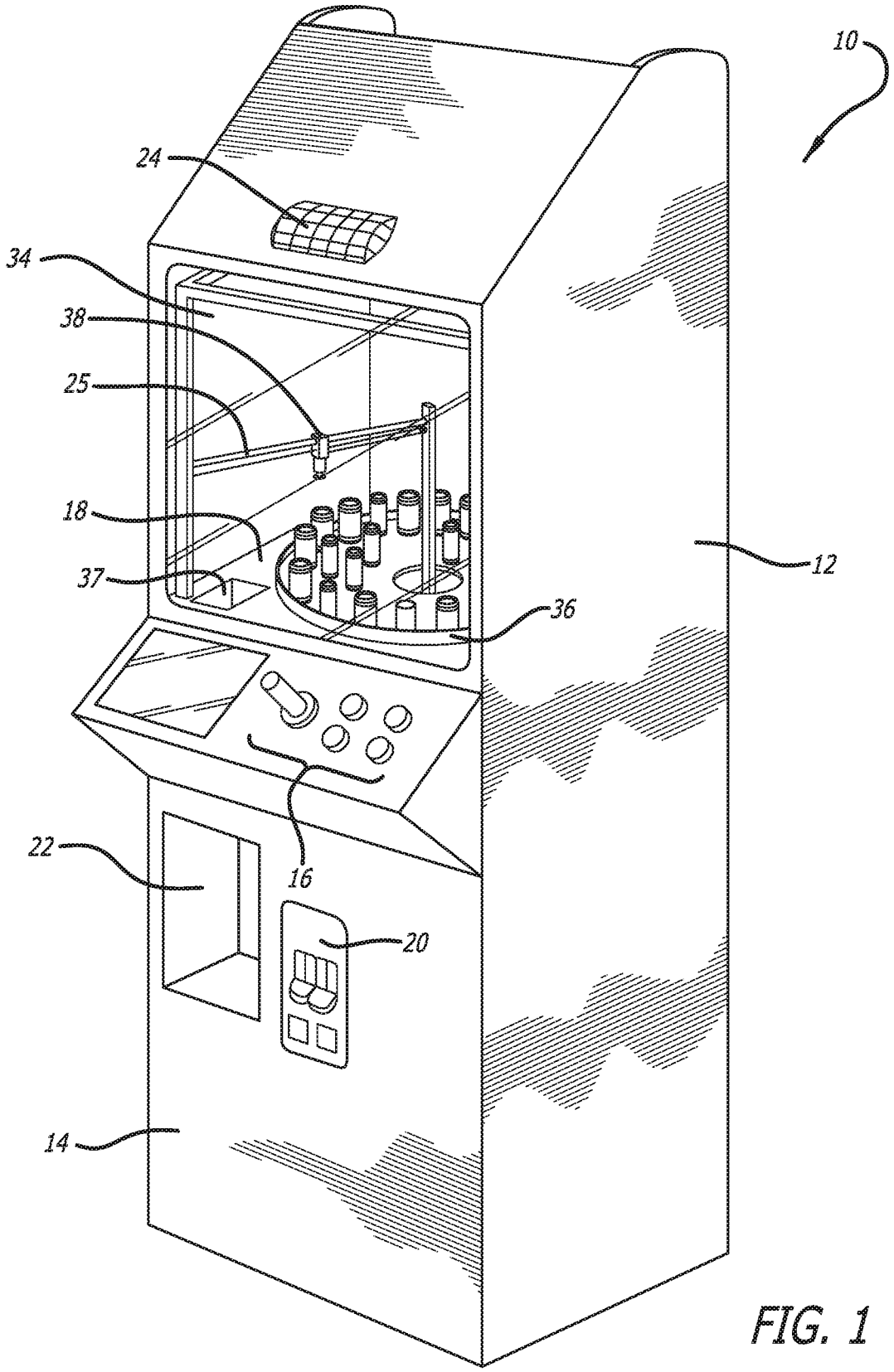
FIG. 1 is an elevated, perspective view of a first embodiment of the present invention.

FIG. 1 illustrates a vacuum type crane game found in arcades, boardwalks, and other locations where coin operated games are played. The vacuum pick-up device is similar to the device disclosed in the present inventor's U.S. Pat. No. 5,855,374 entitled Crane Game Including Vacuum And Rotary Table, the content of which is fully incorporated herein by reference. Depicted is the game apparatus 10 which includes a housing 12, front panel 14, player controls 16, and a playing area 18.

Housing 12 provides a support for the other components of the game apparatus. Housings can take a wide variety of forms; for example, as shown in FIG. 1, housing 12 may be of the stand-up arcade game variety in which a player stands in front of the game or sits on a stool when playing the game. In other embodiments, other types of housings may be provided. For example, a counter-top housing, including approximately the upper half of housing 12 shown in FIG. 1, can be used when the game apparatus is desired to be placed on a table, counter top or other similar surface.

Front panel 14 can be positioned below and/or above the player controls 16 and playing field 18, as shown in FIG. 1. The front panel can also be positioned in a wide variety of other locations on housing 12. Front panel 14 includes a coin deposit slot 20, retrieval bin 22, and speaker 24.

Coin deposit slot 20 typically accepts standard currency coins, game tokens, or bills that are often available in an arcade environment. In some embodiments, other types of monetary input may also be provided, such as a credit card, debit card, magnetic game card, etc. A coin deposited in coin deposit slot 20 or other payment starts a game. A retrieval bin is used to provide prizes to the player which have been won by the player from playing the game. The pick-up device is used to both capture the targets in the playing field and to deliver any successfully captured prizes from playing area 18 to the player-accessible retrieval bin 22 where the player retrieves the prize. With carbonated beverages, transfer of the prize may need to extend all the way to the floor of the retrieval bin so as not to agitate the beverage and cause it to spray out when opened. Speaker(s) 24 emits sounds based on game actions and other game states and is controlled by a game control system.

Player controls 16 allow a player to manipulate events in the game, and typically include a joystick, buttons, switch, knob, or the like. Game action occurs in playing area 18, where a pick up mechanism may be controlled and guided by the player to pick up prize objects, as described below. In the embodiment of FIG. 1, a joystick 28 or similar device (knob, two buttons, etc.) can be manipulated by the player to move the pick-up device in a linear direction (forward and backwards) along a fixed support beam 25. Buttons can also be provided to select various game functions, such as additional velocity control of the pick-up device, number of players in a game, a start button to begin the game, etc. For example, in the described embodiment, a stop or slow button can be pressed by the player to slow down (or stop) the rotational movement of a prize turntable so as to allow the player to more accurately position the pick-up device. In alternate embodiments, the player may be able to control motion of other components of the game, such as horizontal or downward movement of the pick-up device. In some embodiments, a player may get multiple chances to guide the pick-up mechanism with one coin or credit, or, alternatively, the player may be required to insert additional coins.

Game playing area 18 is used to display the game action and prizes to a player and is the area where game action occurs. A transparent shield 34 can prevent the player from interfering with game action. The playing area 18 houses a prize display area 36, a vacuum pick up device 38, and a drive system for moving the pick-up device 38. The pick-up device 38 is a suction cup that is connected to a vacuum where a negative pressure can be created if the suction cup makes a seal with a surface on the target. The player guides the pick-up device 38 horizontally over the playing field, and then either the player of the automatic control of the game lowers the pick-up device 38 over a selected prize in an attempt to capture the prize. If a prize is picked up, the game controller automatically guides the pick-up device 38 with the prize attached to the retrieval bin window 37, which leads to the player's retrieval bin 22.

Figure 2:
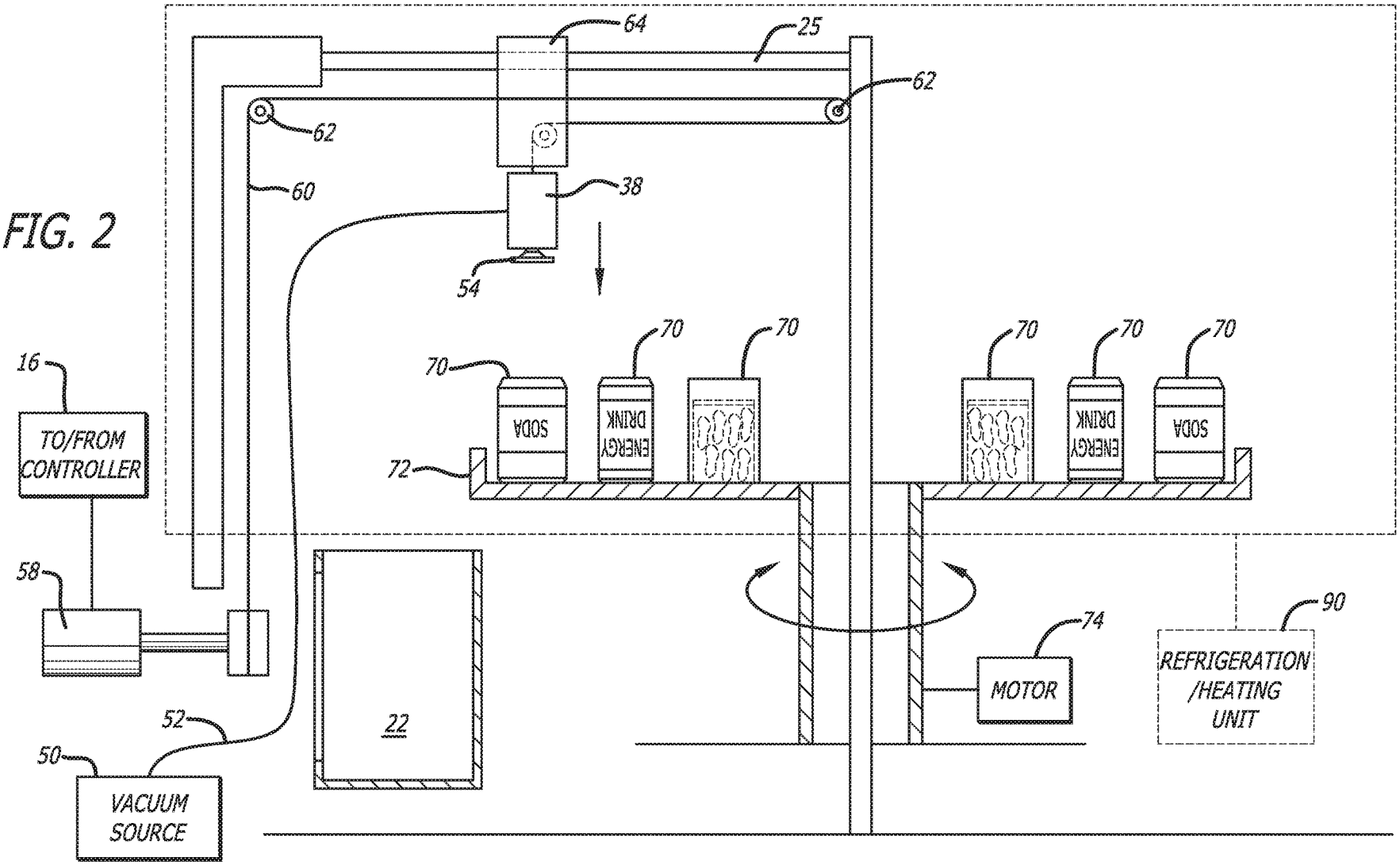
FIG. 2 is a schematic, side view of the pick-up device and targets of the embodiment of FIG. 1.

FIG. 2 illustrates the motion of the pick-up device 38 and the application of the vacuum source to the pick-up device. A vacuum 50 is connected to the pick-up device 38 by tube 52 which communicates a negative pressure to the suction cup 54. Signals from either the player or a motherboard (not shown) are sent to a motor 58 that rotates in two directions and is connected to a cable 60. Cable 60 passes through several pulleys 62 and controls the movement of a carriage 64 mounted on support beam 25. Controlling the motor 58 can move the carriage fore and aft, from the center of the playing field to the outer edge of the turntable. As the turntable rotates, the carriage can be located over every spot where targets are disposed, allowing the player to capture any target below. Further details of the pick-up device can be found in the present inventor's U.S. Pat. No. 10,109,159 entitled Arcade Game With Prize Distribution And Collection System And Method, the contents of which are fully incorporated herein by reference.

Figure 3:
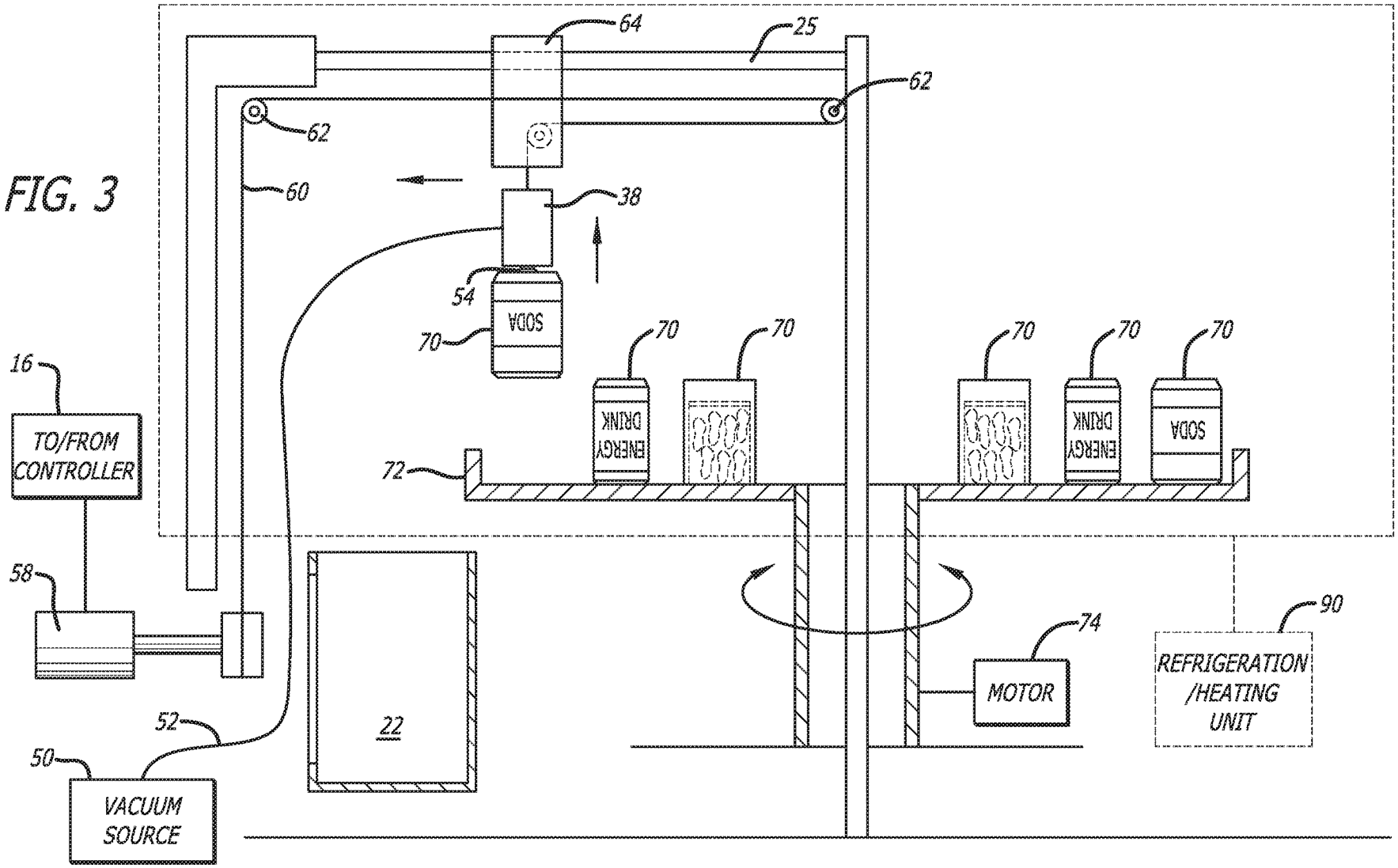
FIG. 3 is a schematic, side view of the pick-up device extracting a target.
Figure 4:
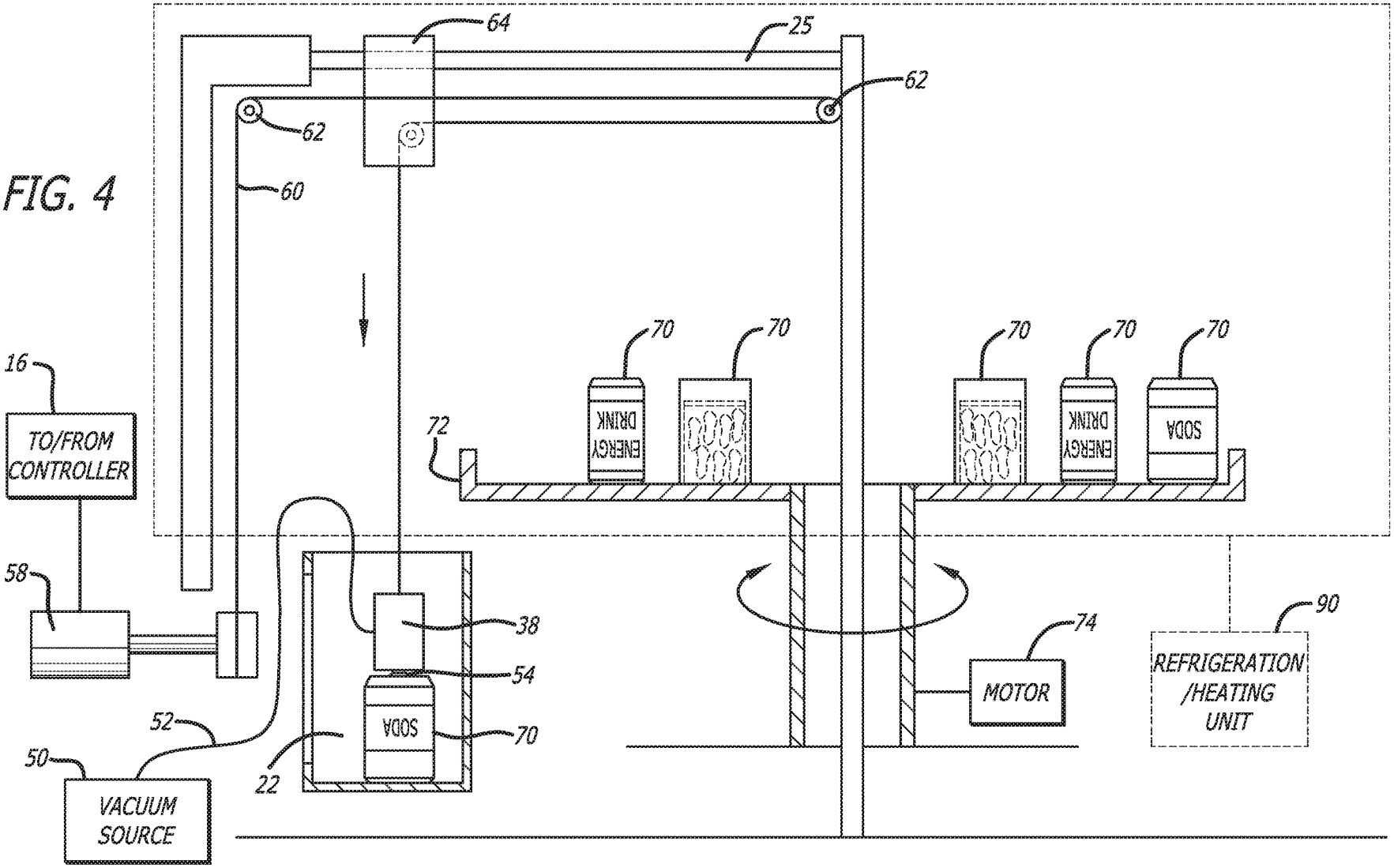
FIG. 4 is a schematic, side view of the pick-up device delivering the target to a retrieval bin.
Figure 5:
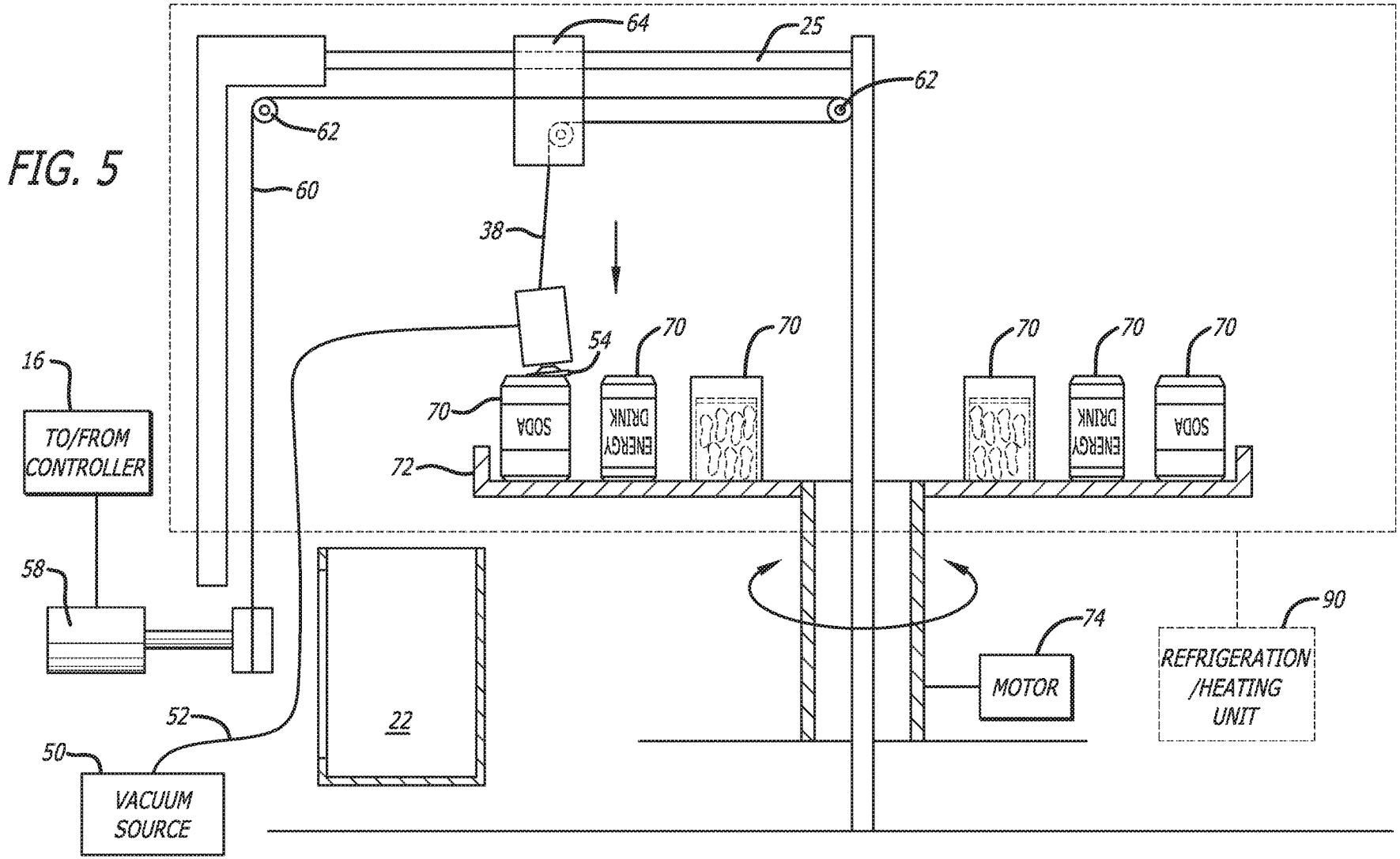
FIG. 5 is a schematic, side view of a failed attempt to capture a target.
Figure 6:
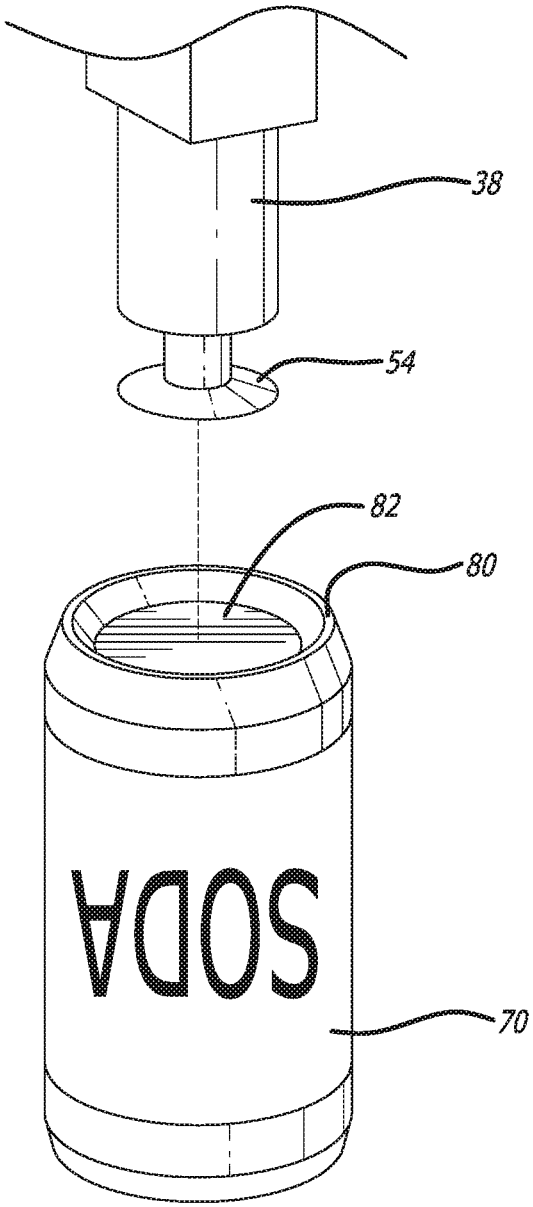
FIG. 6 is an enlarged, perspective view of the pick-up device and can.

The carriage 64 supports the pick-up device, and the pick-up device 38 can be raised and lowered from the carriage 64. The targets 70 are inverted beverage cans arranged about the turntable 72, which in turn is rotated by motor 74. The cans 70 are inverted so as to provide a smooth, round, flat continuous upper surface onto which the pick-up device can engage and capture. The aluminum can 70 is cylindrical (see FIG. 6) with a raised annular rim 80 on the bottom surface and a smooth circular bottom face 82 within the annular rim 80, which when inverted transitions to an upper surface as shown in FIG. 6. The annular rim 80 provides an impediment to successfully capturing the target 70, because if the suction cup 54 does not land completely on the smooth circular bottom face 82 and engages the annular rim 80, the pick-up device 38 cannot engage the target 70 fully and a negative pressure in the suction cup will be denied (see FIG. 5). However, if the player successfully maneuvers the pick-up device 38 so that the suction cup 54 does squarely land onto the smooth circular bottom face of the beverage can, then the pick-up device 38 will successfully capture the can (FIG. 3) and deliver the beverage to the retrieval bin (FIG. 4). The diameter of the suction cup relative to the diameter of the can partially determines the requisite skill needed to successful extract the can. Other factors include the distance between the cup and the can, the speed of the device, and the tolerances of the controls in effecting the outcome of the attempt.

In using beverages or other cans as prizes, the game may be provided with a refrigeration unit 90 to control the temperature inside the playing area. The refrigeration unit 90 delivers cold air to the playing area, ensuring that the beverages are at a pleasing temperature for drinking when won.

Figure 7:
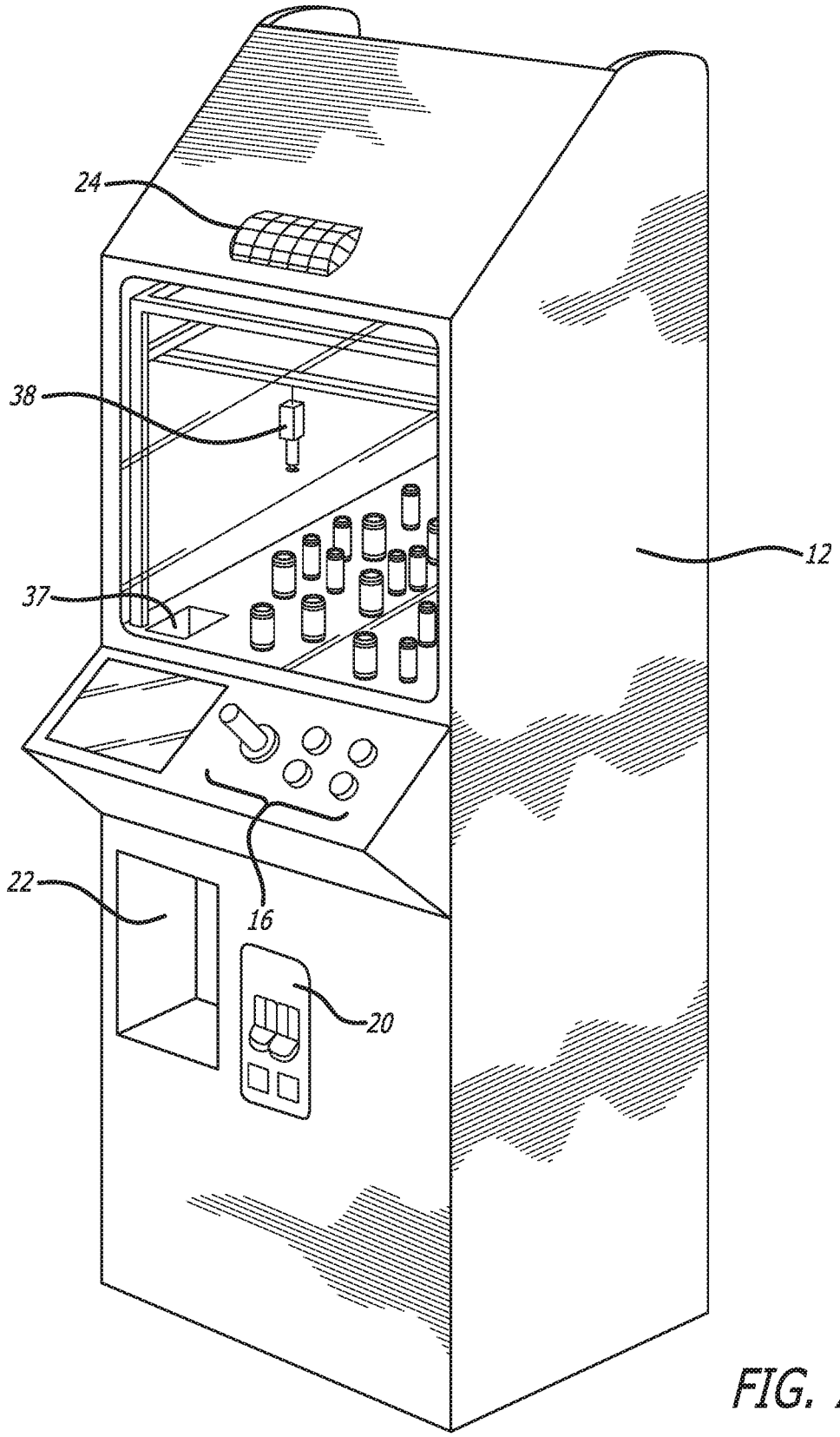
FIG. 7 is an elevated, perspective view of a second embodiment of the present invention.
Figure 8:
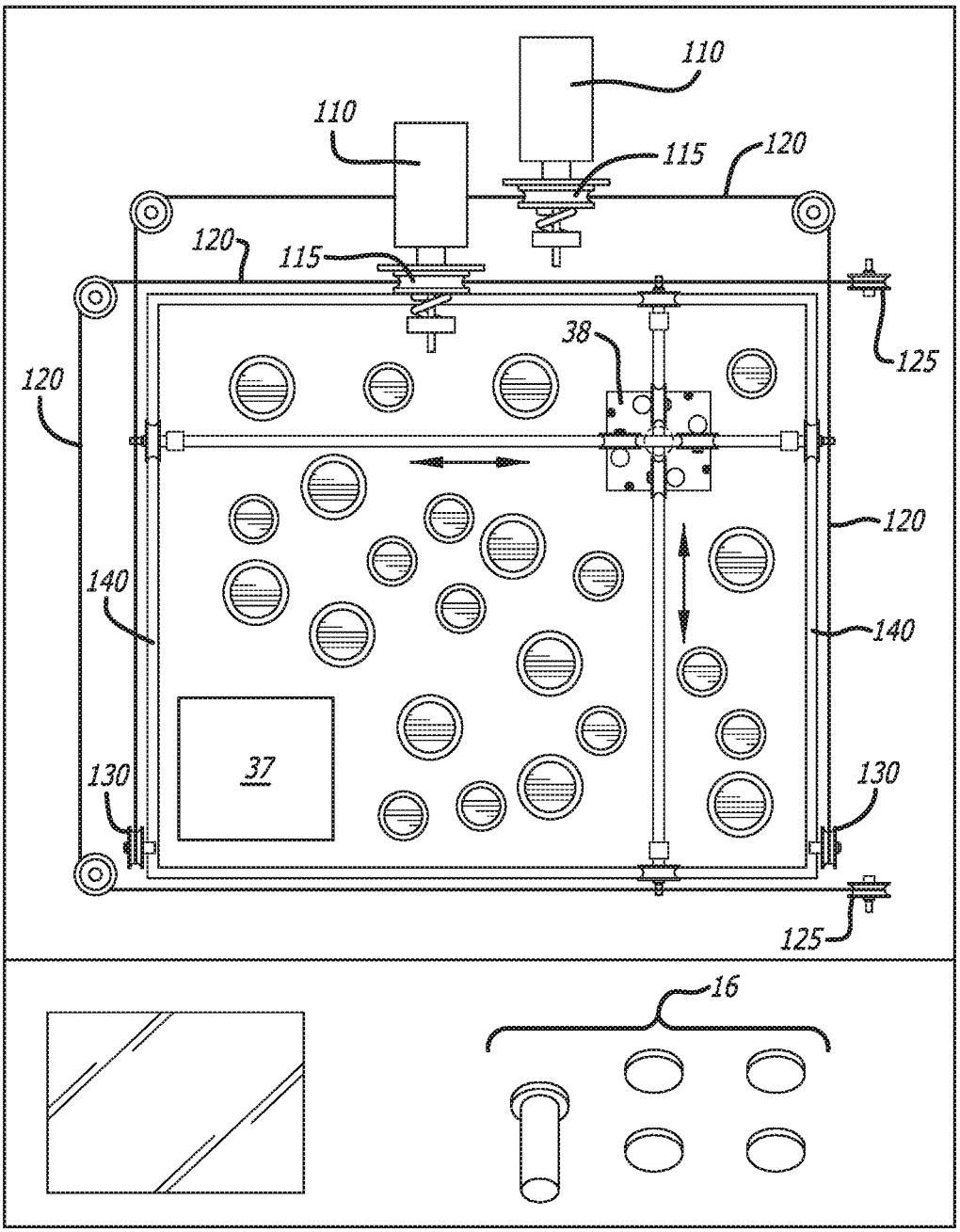
FIG. 8 is a plan view of the pick-up device and targets of FIG. 7.

FIGS. 7 and 8 illustrate a second embodiment of the present invention, where the rotating playing field is replaced with a two directional crane and pulley system. The arrangement of the pulleys and cross motion of the pick-up device is found in the present inventor's U.S. Pat. No. 9,539,496 entitled Crane Game With Modified Pulley System, the contents of which are fully incorporated herein by reference. Two motors 110 have an output shafts that includes a pulley wheels 115 onto which belts 120 are secured. The belts extend across the playing field to pulley wheels 125. The other end of the belts are connected to the pulleys 130 mounted on support 140. As the motors 'shaft rotates, the belts 120 move the pick-up device 38 from one side of the playing field to the other and back. When the pick-up device gets to the end of the playing field, the belt 120 slips in the groove of the pulley similar to a clutch, but without the space needed for the clutch or the complication of a clutch. In other embodiments, a clutch may be used where it benefits the operation of the game.

The object of the game is clear. Place the pick-up device over a beverage can/target 70, such that the suction cup 54 falls completely within the annular rim 80 of the inverted can's bottom surface, such that the suction cup makes contact with the smooth continuous circular bottom face without any contact with the annular rim, or rests precisely on the rim which is more difficult. Only in this manner will the suction cup make an airtight engagement with the beverage can, and allow the suction cup to lift the can from the playing field.

I claim:

1. An arcade game, comprising:

a housing;

a vacuum pick-up device including a circular suction cup having a suction cup diameter;

player controls for maneuvering the vacuum pick-up device;

a plurality of aluminum cans of beverage, inverted and arranged on a playing surface, the inverted aluminum cans having a bottom surface comprising an annular protruding rim and a circular smooth face having a diameter larger than the suction cup diameter;

wherein the player controls allows a player to maneuver the vacuum pick-up device over a selected one of the inverted aluminum cans so as to locate the pick-up device to place the suction cup on the aluminum can's circular smooth face and extract the aluminum can from the playing surface.

2. The arcade game of claim 1, further comprising a refrigeration unit for controlling a temperature of the aluminum cans of beverage.

3. The arcade game of claim 2, wherein the pick-up device moves linearly back and forth along a support member.

4. The arcade game of claim 2, wherein the pick-up device moves in a forwards, backwards, left and right directions based on the player controls.

* * * * *